US008960423B2

(12) United States Patent
Seelhofer

(10) Patent No.: US 8,960,423 B2
(45) Date of Patent: Feb. 24, 2015

(54) OXYGEN-IMPEREABLE, FILLABLE CLOSURE WITH A PUSH BUTTON FOR TRIGGERING

(71) Applicant: Bevaswiss AG, Neuhausen am Rheinfall (CH)

(72) Inventor: Fritz Seelhofer, Lindau (CH)

(73) Assignee: Bevaswiss AG, Neuhausen am Rheinfall (CH)

( * ) Notice: Subject to any disclaimer, the term of this patent is extended or adjusted under 35 U.S.C. 154(b) by 0 days.

(21) Appl. No.: 14/225,921

(22) Filed: Mar. 26, 2014

(65) Prior Publication Data

US 2014/0216958 A1 Aug. 7, 2014

Related U.S. Application Data

(63) Continuation of application No. PCT/EP2013/066129, filed on Jul. 31, 2013.

(30) Foreign Application Priority Data

Aug. 12, 2012 (EP) ..... 12180195

(51) Int. Cl.
*B65D 23/04* (2006.01)
*B65D 81/32* (2006.01)
(Continued)

(52) U.S. Cl.
CPC ..... *B65D 81/3222* (2013.01); *B65D 81/24* (2013.01); *B65D 51/2835* (2013.01); *B65D 2101/0023* (2013.01)
USPC ..... 206/219; 220/521; 220/277; 220/259.1; 215/297; 215/235; 222/83; 222/541.1; 222/145.1

(58) Field of Classification Search
CPC ..... B65D 81/32; B65D 25/08; B65D 83/00; B65D 81/325
USPC ..... 206/219, 222, 221; 220/521, 277, 220/258.3, 259.1, 254.3, 835, 703, 258.1; 215/228, 252, 301, 235–237, 297, 311, 215/387, DIG. 8; 222/80, 83, 494, 556, 222/541.1, 145.1, 145.5; 62/293, 294, 372
See application file for complete search history.

(56) References Cited

U.S. PATENT DOCUMENTS 2,642,870 A * 6/1953 Smith ..... 206/222
3,156,369 A * 11/1964 Bowes et al. ..... 206/222
(Continued)

FOREIGN PATENT DOCUMENTS

AU WO 03/051744 A1 6/2003
JP H08 72921 A 3/1996

OTHER PUBLICATIONS

International Search Report of PCT Application No. PCT/EP2013/066129.
Written Opinion of ISA and English translation of PCT Application No. PCT/EP2013/066129.

*Primary Examiner* — Bryon Gehman
*Assistant Examiner* — Gideon Weinerth
(74) *Attorney, Agent, or Firm* — CUSPA Technology Law Associates, P.A.; Yi Li

(57) ABSTRACT

A fillable closure is used to initiate emptying of a separately fillable capsule molded into this closure. The capsule is made oxygen-impermeable on the inside or outside with a vapor-deposited layer of silicon dioxide or metal. The volume of the capsule can be reduced through pressurization from the top, through deformation of its side walls, for cutting or rupturing a sealing foil. The capsule has an asymmetric push button with a pusher surface, a deformable front and side wall and a stable rear wall. The upper end of the rear wall forms a stationary edge, on which the pusher surface can be pivoted downward through deformation of the front and side wall. On the bottom of the pusher surface, a triangle-shaped blade is formed, which ends in a tip, and its triangle edge forming a cutting edge for piercing and cutting the sealing foil on the bottom of the capsule.

15 Claims, 7 Drawing Sheets

Figure 1:
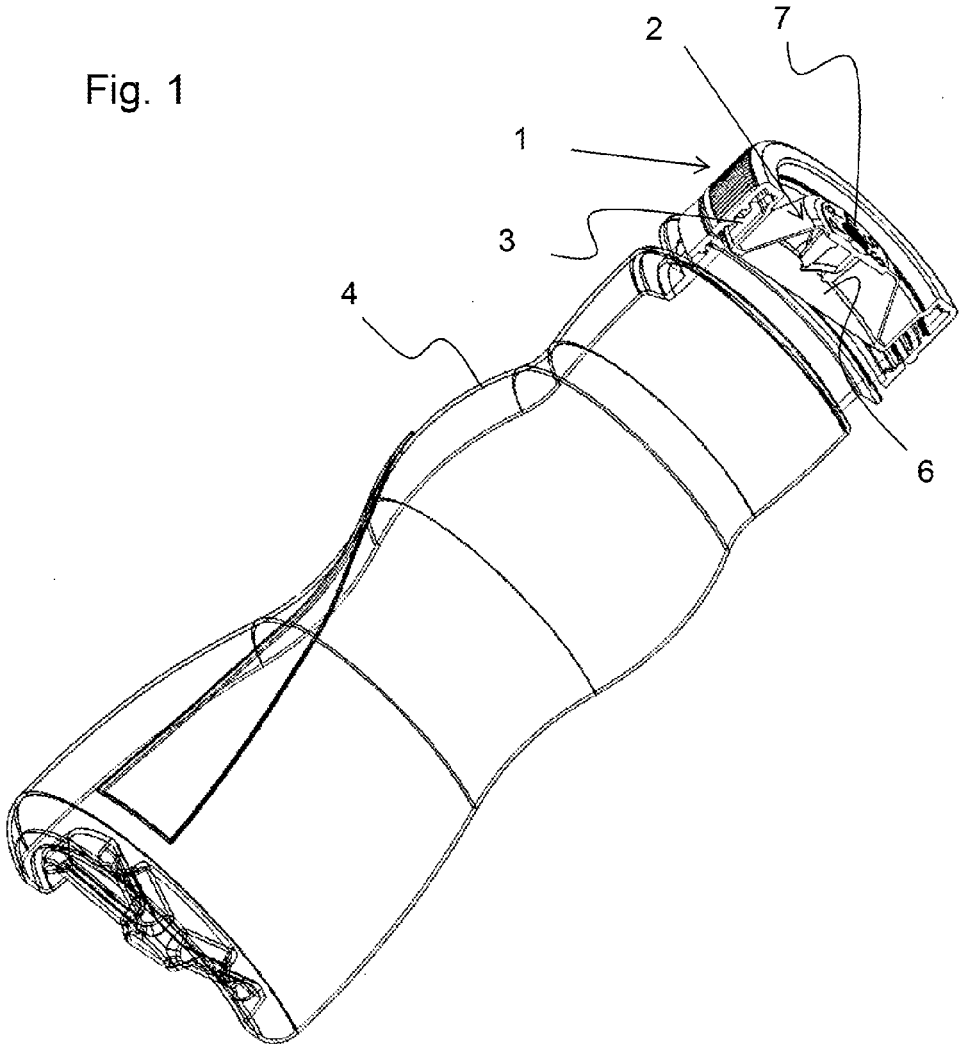

(51) Int. Cl.
*B65D 81/24* (2006.01)
*B65D 51/28* (2006.01)

(56) References Cited

U.S. PATENT DOCUMENTS

| | | | | |
|---|---|---|---|---|
| 3,187,918 | A * | 6/1965 | Moore | 215/11.6 |
| 3,347,410 | A * | 10/1967 | Schwartzman | 222/80 |
| 3,548,562 | A * | 12/1970 | Schwartzman | 53/440 |
| 3,661,636 | A * | 5/1972 | Green et al. | 117/89 |
| 4,103,772 | A * | 8/1978 | Wiegner | 206/222 |
| 4,221,291 | A * | 9/1980 | Hunt | 206/222 |
| 4,795,043 | A * | 1/1989 | Odet et al. | 215/235 |
| 4,993,569 | A * | 2/1991 | Osip et al. | 215/226 |
| 5,147,054 | A * | 9/1992 | Pehr | 215/253 |
| 5,228,592 | A * | 7/1993 | Pellerano | 222/83 |
| 5,255,812 | A * | 10/1993 | Hsu | 220/277 |
| 5,292,025 | A * | 3/1994 | Dubreul | 220/278 |
| 5,736,207 | A * | 4/1998 | Walther et al. | 428/34.7 |
| 5,772,017 | A * | 6/1998 | Kang | 206/222 |
| 5,927,549 | A * | 7/1999 | Wood | 222/83 |
| 5,992,668 | A * | 11/1999 | Elliott | 220/278 |
| 6,041,968 | A * | 3/2000 | Weiteder | 222/83 |
| 6,045,004 | A * | 4/2000 | Elliott | 222/83 |
| 6,513,650 | B2 * | 2/2003 | Mollstam et al. | 206/222 |
| 6,659,308 | B1 * | 12/2003 | Kelder et al. | 222/83 |
| 6,679,375 | B1 | 1/2004 | Coory | |
| 6,877,630 | B2 * | 4/2005 | von Spreckelsen et al. | 220/258.1 |
| 7,163,127 | B2 * | 1/2007 | Seelhofer | 222/83 |
| 7,175,049 | B2 * | 2/2007 | Kastenschmidt et al. | 222/81 |
| 7,279,187 | B2 * | 10/2007 | Daniels et al. | 426/74 |
| 7,748,550 | B2 * | 7/2010 | Cho | 215/228 |
| 7,828,140 | B2 * | 11/2010 | Lee et al. | 206/222 |
| 7,870,967 | B2 * | 1/2011 | Sawyer | 215/225 |
| 7,896,155 | B2 * | 3/2011 | Seelhofer | 206/222 |
| 8,522,995 | B2 * | 9/2013 | Voss et al. | 220/277 |
| 8,590,700 | B2 * | 11/2013 | Yang et al. | 206/222 |
| 8,701,906 | B1 * | 4/2014 | Anderson | 215/227 |
| 8,746,476 | B1 * | 6/2014 | Clause et al. | 215/277 |
| 8,820,554 | B2 * | 9/2014 | Rho | 215/297 |
| 2003/0057209 | A1 * | 3/2003 | Seelhofer | 220/259.1 |
| 2004/0020797 | A1 * | 2/2004 | Fontana | 206/219 |
| 2004/0026422 | A1 * | 2/2004 | Westphal | 220/277 |
| 2005/0263414 | A1 * | 12/2005 | Harilela et al. | 206/221 |
| 2006/0071000 | A1 * | 4/2006 | Weist et al. | 220/278 |
| 2006/0151421 | A1 * | 7/2006 | Rho | 215/297 |
| 2006/0249473 | A1 * | 11/2006 | Kunz | 215/235 |
| 2007/0007231 | A1 * | 1/2007 | Naesje | 215/311 |
| 2007/0023300 | A1 * | 2/2007 | Spector et al. | 206/222 |
| 2007/0023381 | A1 * | 2/2007 | Cerveny | 215/228 |
| 2007/0062826 | A1 * | 3/2007 | Lee et al. | 206/222 |
| 2007/0181522 | A1 * | 8/2007 | Davidson | 215/228 |
| 2008/0142473 | A1 * | 6/2008 | Cho | 215/252 |
| 2008/0179331 | A1 * | 7/2008 | Sharp | 220/521 |
| 2009/0020494 | A1 | 1/2009 | Seelhofer | |
| 2009/0020535 | A1 * | 1/2009 | Joubert et al. | 220/521 |
| 2009/0084814 | A1 * | 4/2009 | Wisniewski et al. | 222/83 |
| 2009/0194533 | A1 * | 8/2009 | Lizerbram et al. | 220/212 |
| 2009/0242561 | A1 | 10/2009 | Wellman | |
| 2009/0308831 | A1 * | 12/2009 | Anderson | 215/227 |
| 2010/0163441 | A1 * | 7/2010 | Kim | 206/221 |
| 2010/0181216 | A1 * | 7/2010 | Melis et al. | 206/219 |
| 2010/0187257 | A1 * | 7/2010 | Roth et al. | 222/129 |
| 2010/0288766 | A1 * | 11/2010 | Seelhofer | 220/212 |
| 2011/0166910 | A1 * | 7/2011 | Marina et al. | 705/7.29 |
| 2011/0174642 | A1 * | 7/2011 | Coon | 206/222 |
| 2012/0183657 | A1 * | 7/2012 | Marina et al. | 426/394 |
| 2012/0193362 | A1 * | 8/2012 | Porter | 220/521 |
| 2014/0027322 | A1 * | 1/2014 | Fontana | 206/222 |
| 2014/0034523 | A1 * | 2/2014 | Valentine | 206/219 |
| 2014/0110281 | A1 * | 4/2014 | Chen | 206/219 |
| 2014/0110282 | A1 * | 4/2014 | Lee | 206/219 |
| 2014/0117020 | A1 * | 5/2014 | Seelhofer et al. | 220/521 |
| 2014/0202895 | A1 * | 7/2014 | Larson | 206/222 |

* cited by examiner

OXYGEN-IMPEREABLE, FILLABLE CLOSURE WITH A PUSH BUTTON FOR TRIGGERING

This application is a continuation of PCT Application No. PCT/EP2013/066129, filed Jul. 31, 2013, which claims the priority of European patent application No. 12180195.5, filed Aug. 12, 2012. All prior applications are herein incorporated by reference in their entirety.

This invention relates to a fillable closure that can be triggered by means of a push button, so that a small, separately fillable capsule moulded inside the closure is opened and emptied into the container, to which this closure is attached. Today, many beverages are already being produced by mixing a concentrate with water. Instead of distributing the ready mixture, it would be much more efficient, if the bottler would fill merely water on-site, and the concentrate would be added to the water in the bottle at the consumer-end, and mixed with it when the bottle is opened for the first time.

Various solutions have been implemented for this purpose in recent years. For example, WO 2009/100544 discloses such a plastic dosing closure. It consists of a threaded cap, a separately fillable capsule inside the threaded cap which can be closed with a sealing foil after filling, and the associated container neck. The capsule, with its sealing foil facing downwards, is held inside the container neck. A cap that is attached to the container neck protrudes into the inside of the container neck and the lower edge of the container neck has a piercing and cutting mechanism by means of which the sealing foil can be opened from the bottom at the lower end of the capsule when opening the plastic dosing closure for the first time so that the substance contained in the capsule falls into container. While turning in the anticlockwise direction—hence in the release direction—the threaded cap is first pushed down on the container neck, whereby the foil of the capsule is pressed on a piercing and cutting mechanism and thus cuts open, while container neck acts as a stop for the threaded cap. Upon further rotation of the threaded cap in the release direction, the threaded cap takes along the container neck, which in turn is attached to a threaded container nozzle, and therefore requires a relatively high torque for unscrewing. If the threaded cap is turned further, it will take along the container neck and the empty capsule located therein and the entire closure is unscrewed from the container nozzle. The elegance of this solution lies therein that it requires a single action, namely only one continuous unscrewing motion of the threaded cap in the release direction. Everything happens automatically in a sequence, that is, the piercing and cutting of the foil, the emptying of the capsule, and the removal of the entire closure, including the emptied capsule, from the container. The disadvantage of this solution lies in the fact that it is complex in design and execution, and that clockwise and left-handed threads are required, and also the assembly of the closure is not without problems.

Another solution, disclosed in U.S. Pat. No. 6,003,728, is a fillable closure with a raised cap lid at the top which can be pressed down. Inside a separate container is a plunger, which sits on top of a disc. The edge of the disc is clicked into place at the bottom edge of the container in a groove. By applying downward pressure, the plunger is pressed down, and the disc is pressed out of its position downward. However, this closure is not easy to fill, and it cannot even be made oxygen impermeable, because it is locked down only with a snap-on fastener. The emptying does not work completely for bulk materials. A portion of the bulk material is left on the disc.

And the US2007/0170142 discloses a fillable closure with a container sealed at the bottom with a foil. This foil is cut by constantly rotating the cap, whereby this rotation activates a knife, which cuts open the foil along its outer edge. The mechanism for this type of cutting is complicated in design and is composed of several parts, and the assembly of the closure is therefore commensurately expensive.

All the known solutions have the disadvantage that the enclosed capsule for receiving a separate fluid, which is to be added to the water in the container immediately before drinking, is not oxygen-impermeable. So, for many substances for which dosing could be metered more sensibly, no suitable closure solutions are available. There are particular vitamin preparations that should be added to the water only immediately before drinking it because they do not last long if they are already mixed in the water. They are very sensitive to light and react with atmospheric oxygen. The molecular structure of the vitamins changes under exposure to light and in the presence of oxygen. As a result, the vitamins lose their effectiveness. Besides, in different closure solutions, the capsule must be filled as a separate component and after that inserted into the closure. Because the preparations must be kept in a separate capsule, and may be added only immediately before drinking the water, such capsules must be made impermeable to oxygen with the use of complex technologies. So far this is accomplished by inserting a thin aluminium foil like a laminate into a foil, which is otherwise usually made only of plastic or cardboard. This solution is not applicable to plastic capsules made by injection moulding. If a capsule were manufactured entirely from an oxygen-impermeable laminate, the automatic opening of the capsule while unscrewing the container closure would be an almost unsolvable task, at least if this opening mechanism is to be simple and inexpensive to manufacture.

The object of the present invention therefore is to provide a fillable closure with a directly fillable capsule space, whereby the fillable capsule space is oxygen-impermeable and lightproof, and the capsule can be opened safely by a single action, without much force or effort, so that the contents of the capsule fall completely into the container on which this fillable closure is mounted. This closure shall also consist of a minimum number of components, so that it does not require any assembly and is therefore cost-effective to manufacture.

This object is achieved by a fillable closure with a push button to initiate the emptying of a capsule moulded into this closure. The capsule can be filled separately and sealed with a sealing foil; characterised in that the capsule is in any case provided on the inside or the outside with a smooth mirror-finish coating of 60 nm to 80 nm thickness of metal or quartz glass (silicon dioxide) using the plasma assisted physical vapour deposition process; and that after filling, this capsule can be sealed with an oxygen-impermeable laminate foil; and that the volume of this capsule can be reduced through pressurisation from the top by the deformation of its side walls, for cutting open or rupturing the sealing foil.

In the figures an embodiment of this fillable closure with push button is illustrated in several views. With these figures, the closure will be described in detail and its function will be explained. In the process, the special coating and sealing of the capsule which provides it oxygen-impermeability are described and illustrated.

In the drawings:

FIG. 1 The closure with a capsule formed therein, and this closure is placed on a bottle, all illustrated in a sectional view along the centre line of the bottle.

Figure 2:
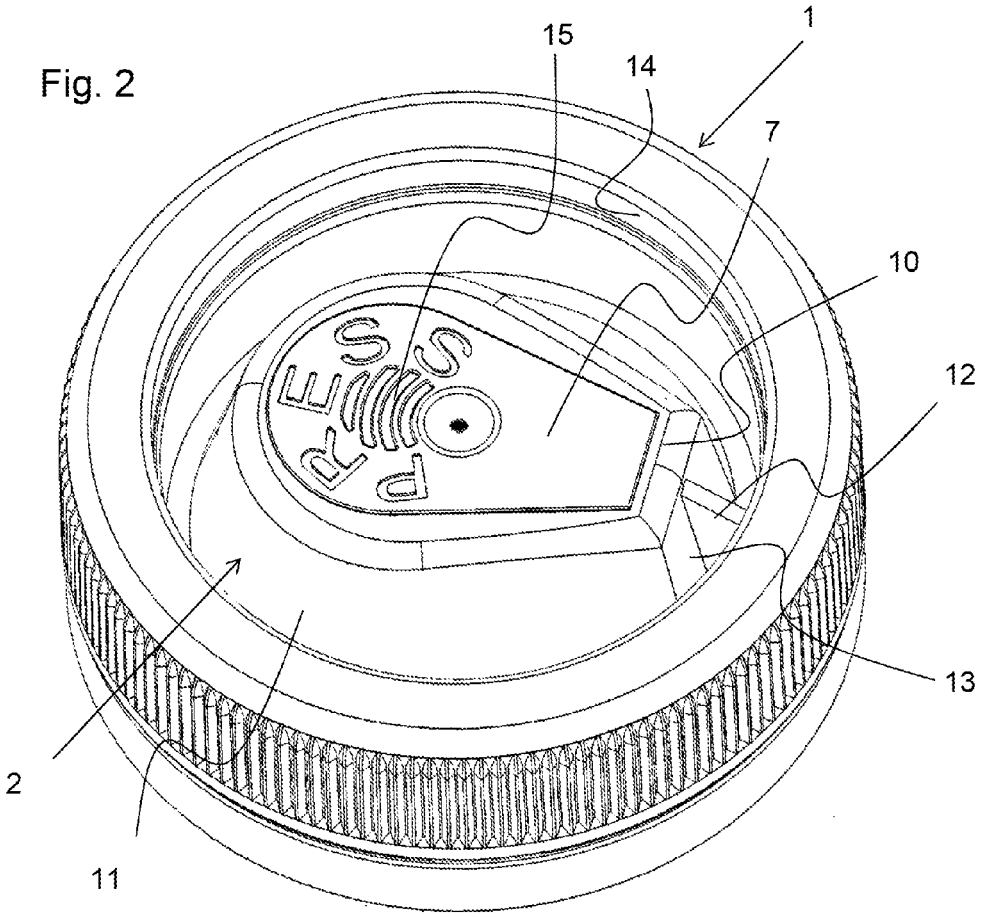
Figure 3:
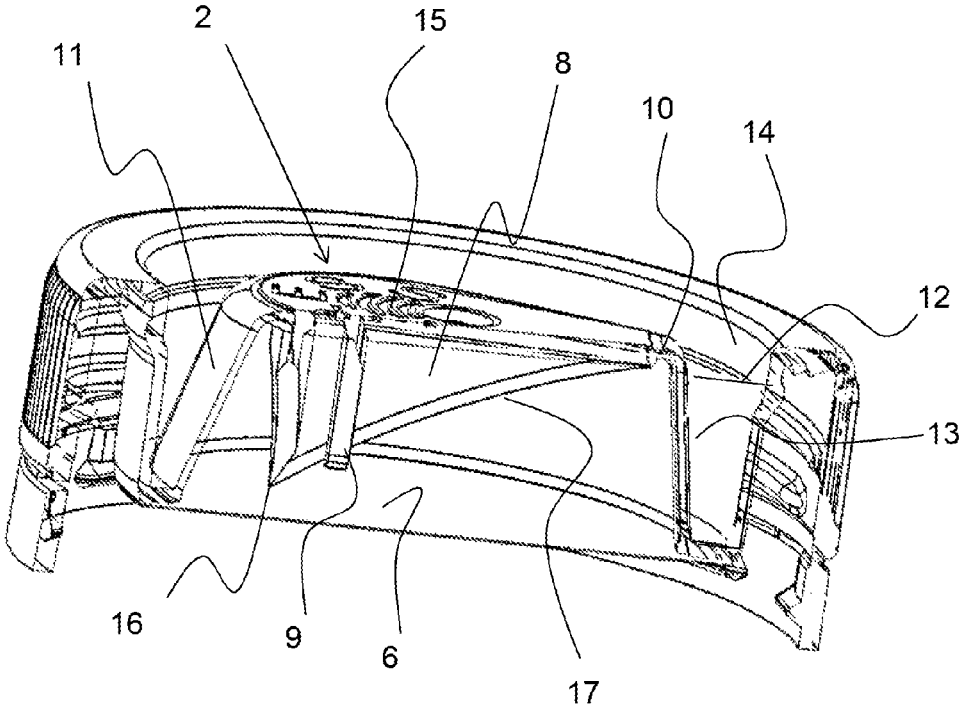
Figure 4:
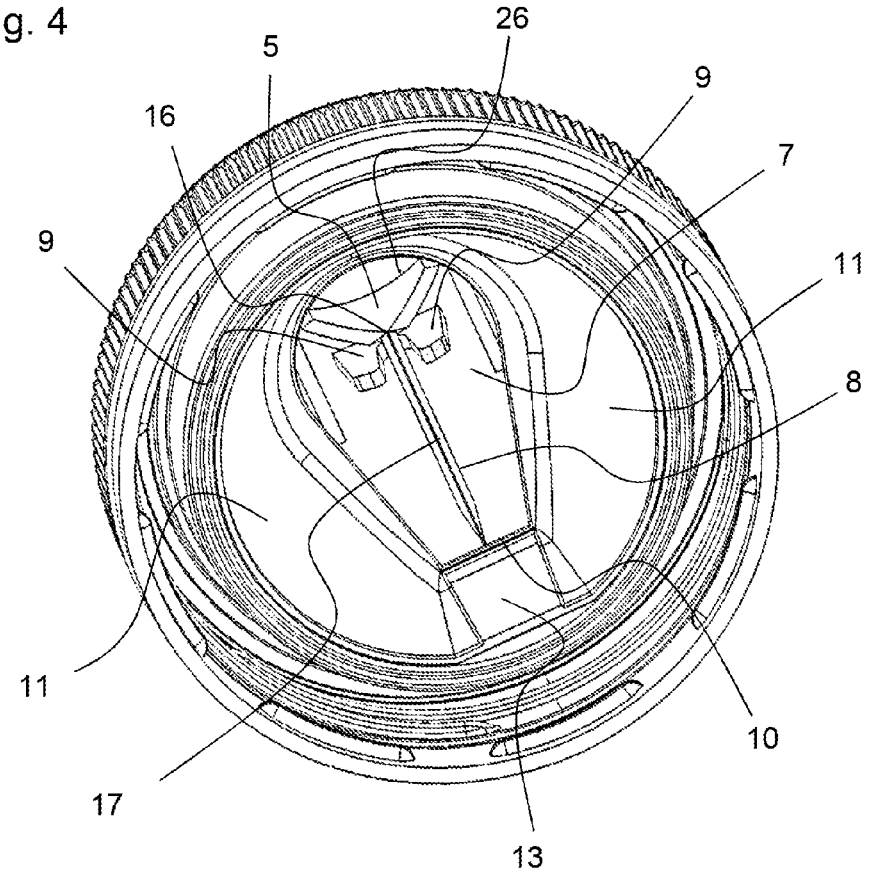
Figure 5:
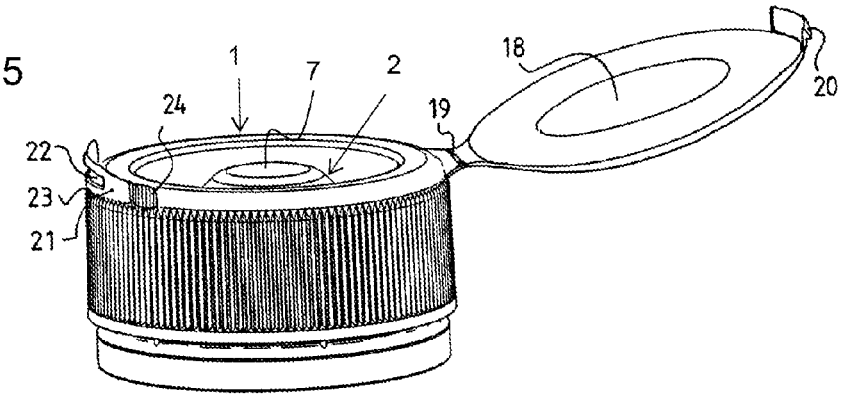
Figure 6:
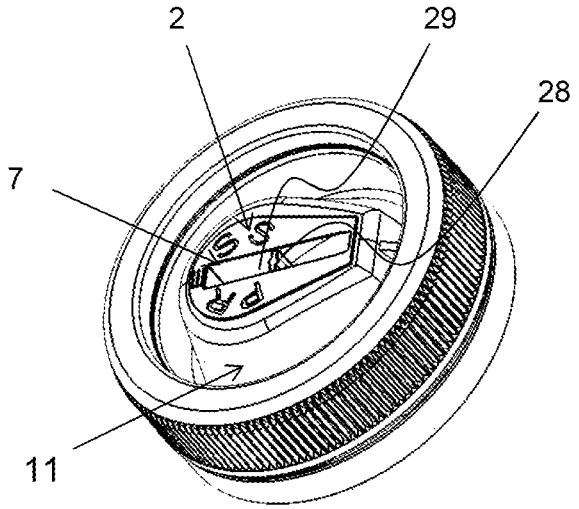
Figure 7:
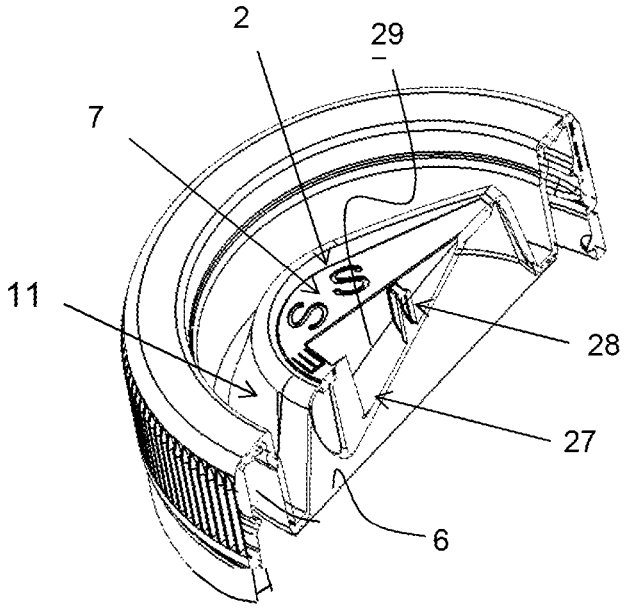
Figure 8:
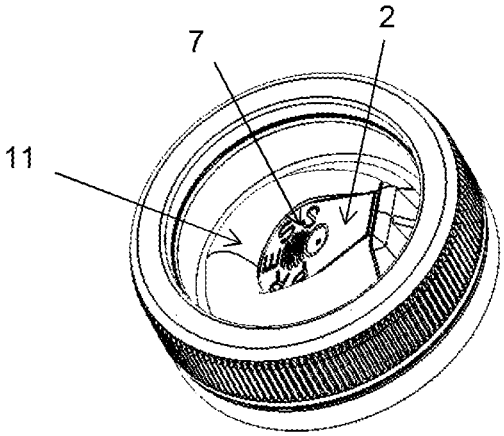
Figure 9:
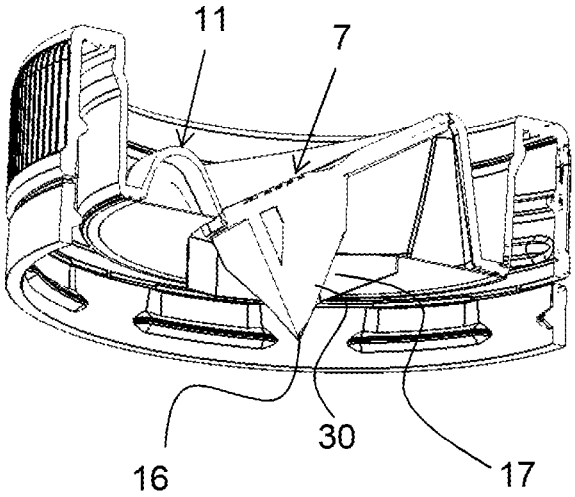
Figure 10:
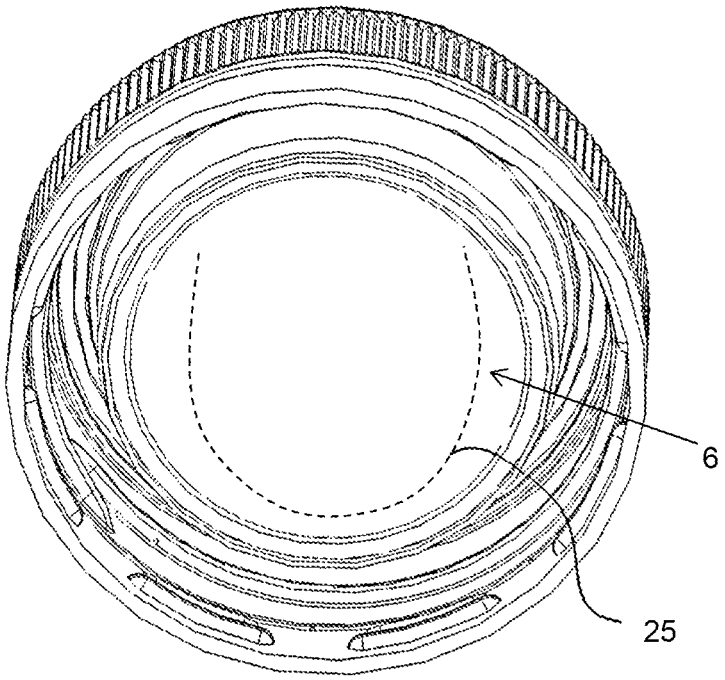
Figure 11:
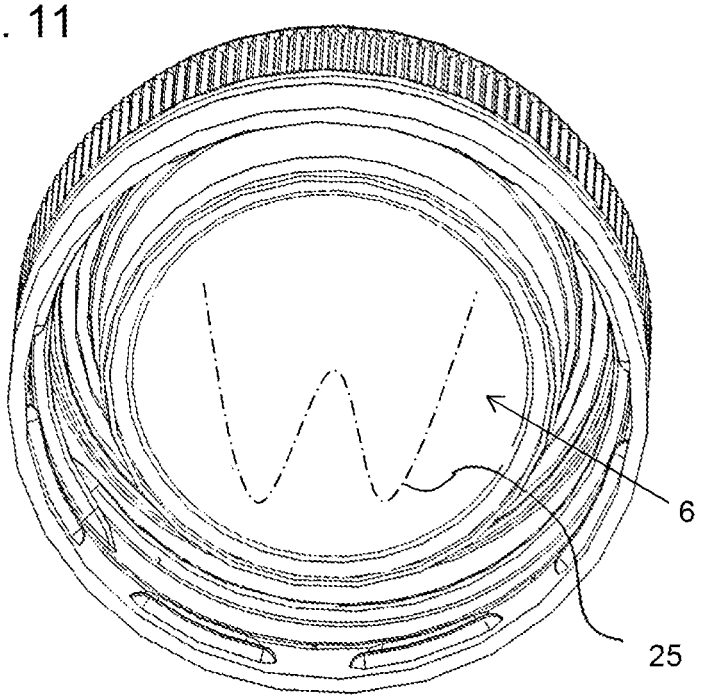

FIG. 2 Only the closure with the asymmetric capsule formed therein is shown in a perspective top view;

FIG. 3 The closure with its capsule sealed with a sealing foil shown in a diametric sectional view;

FIG. 4 The closure without the sealing foil on its enclosed capsule, shown in a sectional view from the bottom;

FIG. 5 A closure with a tamper-proof seal mechanism;

FIG. 6 An alternative closure with an asymmetric capsule formed in it, shown in a perspective top view;

FIG. 7 The closure in FIG. 6 with the asymmetric capsule formed in it, shown in a diametric sectional view;

FIG. 8 Another closure with a capsule formed in it, shown in a perspective top view, after depression of the pusher surface of the capsule;

FIG. 9 The closure in FIG. 8 after depression of the pusher surface of the capsule shown in a diametric longitudinal section view;

FIG. 10 The container closure with sealed capsule seen from below, with a U-shaped weakening line in the sealing foil;

FIG. 11 The container closure as seen from below, with a W-shaped weakening line in the sealing foil.

In FIG. 1, one can see this closure 1, which enables the emptying of the capsule 2 formed therein with a single direct actuation. The closure 1 forms a screwable cap for the threaded neck 3 of a bottle 4. In the inner part of closure, it forms a capsule 2 with an open bottom, which fills up the entire inner part of the closure like a dome. This capsule 2 is provided on its inside or outside or even on both sides with a smooth mirror-finish transparent coating of quartz glass or silicon dioxide using the plasma assisted physical vapour deposition process. This deposition can take place in a temperature range from 10° C. to 30° C. The thickness of this deposition is 60 nm to 80 nm and offers at least an oxygen impermeability. In the case of a metal vapour-deposited layer, which is not transparent, the light tightness is achieved. Depending on the substance which will be filled in the capsule 2, the top of the capsule 2, which is usually made of injection-moulded plastic, can be made light-tight or oxygen impermeable or even both through a vapour-deposited coating. The capsule 2 may be coated on the inside or alternatively on the outside of the capsule 2, or even a two-sided coating may be applied. The surface of the coating is in this case very smooth, ideally as mirror-polished, and it typically has a roughness of approximately 80 nm. With such a vapour-deposited coating, improved barrier properties can be achieved compared for example with the so-called EVOH coatings, which are otherwise used as a plastic barrier. EVOH, unlike PVDC, does not contain any chlorine, dioxins, metals and any other ingredients that may cause endocrinological disorders. However, a vapour-deposited silicon dioxide or metal coating proves to be a much better barrier to oxygen, and in the case of a metal coating, also to light.

The capsule 2 is filled with the desired substance in an overturned position of the closure 1, in which it forms a shell, and afterwards sealed with a sealing foil 6. This sealing foil 6 is formed as a laminate, wherein the laminate is made of at least one plastic film and an aluminium foil, or, alternatively, of a plastic foil on one side with a vapour-deposited layer of metal or quartz glass, so that the sealing film 6 is oxygen impermeable or even light-tight. Alternatively, a commonly used seal foil made of plastic can be welded onto it, which is afterwards made oxygen impermeable or even light-tight by vapour deposition of metal or quartz glass. This sealing foil 6 is then welded on to the edge of the overturned capsule 2. Afterwards the capsule 2, along with its contents, is sealed impermeable to oxygen, or if using a metal vapour-deposition, it is even sealed to be light-tight. This makes it an ideal container for highly sensitive materials and substances such as all kinds of vitamins.

The flat top of the capsule 2 forms a pusher surface 7. On the underside of the pusher surface 7, as shown in FIG. 3, there is a blade 8 formed, and on both sides of the blade 8 on the underside of the pusher surface 7, there are punches 9 formed for pressing down the cut foil 6, as can be seen more clearly in the other figures. The opening of the foil 6 is in fact not so easy to achieve, because oxygen-impermeable foils are quite tough. It is also not enough to puncture it in only one place, because this will not ensure that the contents slide down completely from the capsule, especially if the contents are bulk materials, such as a fine powder. Therefore, the closure presented here has its own specific features to ensure complete emptying of the contents, and these features are described and explained in the following.

FIG. 2 illustrates only the closure with the capsule 2 formed inside from a perspective top view. Here, one can see the special form of the capsule 2. It has an asymmetrical shape, in that pusher surface 7 has a circular shape on the front, that is, on the left side of the image, but on the back, that is, on the right side of the image, it converges to a trapezium. On the whole, the flat pusher surface forms a drop shape with a cut-off rear end. The rear closing edge 10 of the pusher surface 7 forms a hinge axis on which the pusher surface 7 can be pressed down through deformation of the front part of the capsule wall 11. To ensure that the closing edge 10 remains stationary, at a right angle to the closing edge, a bar 12 is moulded to the rear, flat and rigid capsule wall 13, which forms a bridge to the inner wall 14 of the threaded cap of the closure. If pressure is applied with a finger on the pusher surface 7, it pivots around the closing edge 10, that is, around the upper edge of the rigid capsule wall 13 downwards, through deformation of the soft capsule wall 11 in the front and side of the capsule 2. So you have here a short swivel axis at an elevated position relative to the rest of the capsule. A ribbing 15 and the label 'PRESS' on the pusher surface 7 indicate to the user that he must press the pusher surface 7 to operate the closure, and to cause the emptying of the capsule 2.

FIG. 3 shows this closure with its capsule 2 closed with a sealing foil 6, in a diametric sectional view. On the right side in the image, is the flat, rigid rear wall 13 of the capsule 2, which serves as a support to the closing edge 10 which acts as a hinge. This rear wall 13 acting as a support wall is connected to the inner wall 14 of the threaded cap by means of a bar 12 moulded at a right angle to it, and is therefore rigid and non-deformable. The remaining part of the capsule wall 11 is however soft and deformable. In order to ensure that the sealing foil 6 is opened when the pusher surface pivots downwards on its stationary closing edge 10, a blade 8 is moulded on the underside of the pusher surface 7. This is executed here in a triangular shape and extends over the entire length of the pusher surface 7. This triangle is the highest at the front and from there it ends in a tip 16, from which the lower side of this triangle runs into the stationary closing edge 10. And this lower side of the triangle or blade 8 forms a sharp cutting edge 17. When the pusher surface 7 is pressed down and as a result, it pivots on the closing edge 10 that acts as a hinge, first the tip 16 pierces the sealing foil 6, and thereafter as the pusher surface 6 pivots further downwards, the cutting edge 17 cuts the sealing foil 6 to two halves. With this slit now present in the sealing foil 6 it is not yet ensured that the capsule contents will fall down safely and completely. To ensure this, on both sides of the blade 8 punches 9 are formed below the pusher surface 7, so both sides of the blade 8 extend downward and reach slightly less far down than the tip 16 of the blade 8. When the sealing foil 6 is pierced once, and afterwards cut from the needle hole by the cutting edge 17 of the blade, the punches 9 press the two resulting halves of the sealing foil 6 down, so that they create an inclination all around, which ensures that the contents of the capsules lying on them slip down.

FIG. 4 shows the closure without the sealing film in a sectional view from below. Here, one can see the deformable side wall 11 of capsule 2, and the flat pusher surface 7 from below. Longitudinally to its centre runs the blade 8 with its cutting edge 17. On either side of the blade 8 one can see the punch 9 and on the front end of the blade 8, a reinforcing wall 5 is formed, which is connected along a curved line 26 to the pusher surface 7 and runs out to the tip of the blade 8, and is connected with the front triangular side of the blade 8. This reinforcing wall 5 ensures that the blade 8 cannot bend laterally when the pusher surface 7 is pressed down.

Such a closure may also be provided with a tamper-proof seal mechanism. FIG. 5 shows a solution for the realisation of tamper-proof seal. When the closing cap 1 like the one shown in FIGS. 1 to 4 is manufactured, anyone can depress the freely accessible pusher surface 7 and empty the contents of the capsule 2 into the bottle contents. This pressing down of the pusher surface 7 may therefore be abused: Purely out of mischief, someone could simply press down the pusher surface 7 of a row of bottles on a shelf. The barrier for this is relatively low. To prevent this, the closing cap 1 shown here has a hinged lid 18 moulded to its edge. From the outer edge of the lid 18, that is, on the opposite side of the hinge 19, a latch 20 is moulded as a snap fit element. If the lid 18 side is changed and swung down on the closing cap 1, then latch 20 snaps into a window 22 formed the strip 21. Henceforth the lid 18 can be swung open and access to the push button and its pusher surface 7 can be given only upon tearing away the strip 21 from the closing cap 1. For this, the strip 21 is formed on a thin spot 23 on the upper outer edge of the closing cap 1. By gripping the pull tab 24, the strip 21 can be torn along the circumference of the closing cap 1 by breaking the thin spot 23. To prevent the strip 21 from being carelessly discarded, the thin spot 23 can be designed in such a way that it does not extend over the entire length of the strip 21, so that it remains secured to the closing cap 1 even after a partial ripping, but the latch 20 is released, so that the lid 18 can be swung. Overall, the entire closure solution consists of only two parts, namely the lid cap 1 with a lid 18 which at best is formed as a single piece for the tamper-proof seal, and the fillable capsule 2 which is moulded inside, and a separate sealing foil for closing the filled capsule 2.

To ensure the opening of the sealing foil, instead of a blade 8 with a sharp tip 16 and cutting edge 17, a simple blunt punch can be formed beneath the pusher surface 7. To ensure that the capsule 2 is emptied completely, the sealing foil 6, though made oxygen-impermeable, can be specifically weakened.

An alternative embodiment of such a closure having an asymmetrical capsule 2 is shown in FIG. 6. Here the capsule 2 has a recess 29, which extends over its length, and is reinforced in the centre with a bridge 28. This recess forms a punch on the lower side, which helps to separate the weakened sealing foil extending beneath it solely through pressurisation with this punch.

FIG. 7 shows the variant of FIG. 6, in a section. This provides a view of the interior of the recess 29, in which one can see the material bridge 28 which connects the two side walls of the recess 29 and makes it stable, and altogether forms the punch 27. At the front of the capsule one can see the deformable wall 11 of the capsule.

FIG. 8 shows yet another variant of a closure with asymmetric capsule 2, again with yet another capsule design. As shown in the illustration, capsule 2 is pressed down by applying pressure on its pusher surface 7. The deformable wall 11 has become curved accordingly. FIG. 9 shows what has happened through the pressing down on the underside of the pusher surface 7. On the underside of the presser surface 7, a wedge 30 is formed, which forms a cutting edge. When this wedge 30 is pressed down on the sealing foil running underneath it, the foil is pierced by the tip 16 of the wedge 30, and then cut open with the cutting edge. Through the shape of the wedge the two halves of the seal foil are spread apart when being pressed down further, so that the content of the capsule drops down safely through the opened sealing film.

FIGS. 10 and 11 show closures with their sealing foils 7 on the separately fillable, enclosed capsules 2 from below. In both examples, you can see a weakening line 25 in the sealing foil 6. In the first case, according to FIG. 10, this weakening line is realised by a U-shaped stamping line, in the second case, according to FIG. 11, the weakening line is made by a W-shaped stamping line. It is important that the weakening line 25 form a continuous line, preferably one which encloses the flap of foil hanging down from here, and that no weakening lines intersect on the foil anyway. With this a secure opening of the foil 6 is achieved and the contents of the capsule 2 can freely fall down through the open sealing foil 6.

What is claimed is:

1. A fillable closure comprising:

a fillable capsule (2) moulded into the closure that is in a form of a cap and configured to connect to a bottle neck, the capsule filling up an inside of the closure in a form of a dome, and the capsule having a coating of metal or silicon dioxide on either an inside or an outside, or on both sides thereof, the capsule (2) comprising:

an open bottom sealed by an oxygen-impermeable sealing foil (6) after filling the capsule;

a top positioned at an upper end of the closure forming a pusher surface (7) functioning as a push-button of the closure to initiate emptying the capsule;

a protruding element (8, 27, 30) formed on an underside of the pusher surface (7) configured to open the sealing foil (6) on the bottom of the capsule;

a deformable front and side wall (11) and a rigid rear wall (13) that is not deformable; an upper edge (10) of the rigid rear wall forming a stationary pivot hinge on which the pusher surface (7) can be pivoted downward through deformation of the front and side wall (11);

wherein under pressurization on the pusher surface (7), the front and side wall deform below the upper edge of the rigid rear wall, causing opening the sealing foil (6) by the protruding element.

2. The fillable closure according to claim 1, wherein the pusher surface (7) has a drop shape with a cut-off rear end at the upper edge of the rigid rear wall of the capsule.

3. The fillable closure according to claim 1, wherein the rigid rear wall (13) is connected to an inner wall (14) of the closure through a bar (12) such that the rear wall (13) is not deformable.

4. The fillable closure according to claim 1, wherein the protruding element is a triangle-shaped blade (8) with a sharp tip (16) and a cutting edge (17) for piercing and cutting the sealing foil (6) on the bottom of the capsule (2).

5. The fillable closure according to claim 4, wherein a punch (9) is formed on both sides of the triangle-shaped blade (8) at the underside of the pusher surface (7) for pressing down two halves of cut sealing foil (6) and thereby ensuring the capsule (2) is emptied completely.

6. The fillable closure according to claim 5, wherein the punch (9) extends downwards lesser than the tip (16) of the triangle-shaped blade (8).

7. The fillable closure according to claim 4, wherein a reinforcing wall (5) is formed on a front end of the triangle-shaped blade (8), connecting along a curved line (26) to the pusher surface (7), for ensuring the triangle-shaped blade not bending laterally when the pusher surface is pressed down.

8. The fillable closure according to claim 1, wherein the protruding element is a recess (29) on the pusher surface protruding downward and forming a punch (27) on the underside of the pusher surface for pushing open the sealing foil (6) on the bottom of the capsule (2).

9. The fillable closure according to claim 8, wherein the recess (29) extends through the length of the pusher surface, and is reinforced therein with a bridge (28).

10. The fillable closure according to claim 1, wherein the protruding element is a wedge (30) that forms a cutting edge.

11. The fillable closure according to claim 1, wherein the front and side wall of the capsule is soft and a volume of the capsule (2) can be reduced through pressurization on top of the capsule by deformation of the front and side wall of the capsule (2).

12. The fillable closure according to claim 1, wherein the front wall is foldable in a section lower than the upper edge (10) of the rigid rear wall.

13. The fillable closure according to claim 1, wherein the sealing foil is provided with at least one continuous weakening line (25) so that when an internal pressure in the capsule (2) increases, the sealing foil (6) closing the capsule (2) ruptures along ruptures along the at least one weakening line (25).

14. The fillable closure according to claim 1, wherein the sealing foil comprises one or more continuous, non-intersecting weakening lines (25) in a form of fillets.

15. The fillable closure according to claim 1, wherein the closure further comprises a lid (18) formed on a hinge (19) on an edge of the closure to provide a tamper-proof seal, and a latch (20) is moulded to an opposite side of the hinge (19) as a snap fit element; when the lid (18) is closed, the latch (20) engages with a window (22) formed in a strip (21) on an edge of the closure.

* * * * *